US007118467B2

(12) United States Patent
Sun et al.

(10) Patent No.: US 7,118,467 B2
(45) **Date of Patent: *Oct. 10, 2006**

(54) PNEUMATIC BUFFING MACHINE

(76) Inventors: Yung-Yung Sun, No.66, Shangtian St., Dali City, Taichung County 412 (TW); Chuan Ching Cheng, 4F, No. 16, Alley 8, Lane 33, Sec. 2, Sing-an Rd., Beitun District, Taichung City 406 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/101,488

(22) Filed: Apr. 8, 2005

(65) Prior Publication Data

US 2005/0170763 A1 Aug. 4, 2005

Related U.S. Application Data

(63) Continuation-in-part of application No. 10/689,692, filed on Oct. 22, 2003, now abandoned.

(51) Int. Cl.
*B24B 23/00* (2006.01)
*B24B 27/08* (2006.01)
*B24B 55/04* (2006.01)
*B24B 55/06* (2006.01)

(52) U.S. Cl. ..... 451/359; 451/344; 451/353; 451/357; 451/451; 451/456

(58) Field of Classification Search ..... 451/344, 451/353, 357, 359, 451, 456
See application file for complete search history.

(56) References Cited

U.S. PATENT DOCUMENTS 2,541,431 A * 2/1951 Muehlbauer ..... 81/6
4,467,565 A * 8/1984 Wallace et al. ..... 451/357
4,854,085 A * 8/1989 Huber ..... 451/357
5,125,190 A * 6/1992 Buser et al. ..... 451/456
5,319,888 A * 6/1994 Huber et al. ..... 451/357
5,775,981 A * 7/1998 Yang ..... 451/295
5,879,228 A * 3/1999 Sun ..... 451/357
6,213,851 B1 * 4/2001 Garcia et al. ..... 451/270
6,264,408 B1 * 7/2001 Lung et al. ..... 409/182
6,312,322 B1 * 11/2001 Chang et al. ..... 451/344
6,382,643 B1 * 5/2002 Baker ..... 280/79.11
6,447,387 B1 * 9/2002 Tseng ..... 451/456
2004/0229555 A1 * 11/2004 Hutchins ..... 451/357

* cited by examiner

*Primary Examiner*—Joseph J. Hail, III
*Assistant Examiner*—Bryan R. Muller
(74) *Attorney, Agent, or Firm*—Rosenberg, Klein & Lee

(57) ABSTRACT

A pneumatic buffing machine including a housing having an internal chamber in which a pneumatically driven motor set is mounted. The motor set includes an eccentric block for driving a grinding disc. A skirt shade is screwed under a bottom of the housing by means of outer thread and inner thread. The skirt shade has a large diameter section and a small diameter section. The skirt shade is formed with a central through hole. The eccentric block of the motor set is passed through the through hole and accommodated in the large diameter section. A shoulder section is formed between the large diameter section and the small diameter section and adjacent to the outer thread of the small diameter section. A top end of the small diameter section serves as a stopper section. When the skirt shade is screwed into the chamber of the housing, the bottom end of the housing abuts against the shoulder section to tightly fix the skirt shade and the stopper section abuts against the bottom of the motor set to fix the motor set in the chamber of the housing.

2 Claims, 8 Drawing Sheets

PNEUMATIC BUFFING MACHINE

CROSS-REFERENCE TO RELATED APPLICATION

This application is a Continuation-In Part of Ser. No. 10/689,692 filed 22 Oct., 2003, and entitled "PNEUMATIC HANDLE GRINDING APPARATUS", now abandoned.

BACKGROUND OF THE INVENTION

The present invention is related to an improved pneumatic buffing machine, and more particularly to a pneumatic buffing machine in which the housing and the skirt are separately formed and the skirt shade is directly screwed into the housing without using any screws.

FIGS. 5 and 6 show a conventional pneumatic buffing machine. The buffing machine includes a housing 5 integrally having a skirt 51 for fitting with a dustproof shade 55. The housing 5 has an internal chamber 52 in which a pneumatically driven motor set 53 is mounted. A control seat 54 is disposed on one side of the housing. 5 for controlling intake and exhaust. Accordingly, the air is controlled to enter the chamber 52 of the housing 5 for driving the motor set 53. The motor set 53 further drives a grinding disc 56 at the bottom end of the motor set 53 for buffing a work piece.

A fixing member 6 is screwed in the chamber 52 of the housing 5 for fixing the motor set 53 in the chamber 52. The fixing member 6 is formed with an outer thread 61, while the wall of the chamber 52 is formed with inner thread 521 above the skirt 51, whereby the fixing member 6 can be screwed in the chamber 52 for stopping and fixing the motor set 53 in the chamber 52. The circumference of the fixing member 6 is formed with several notches 62 for a tool to screw the fixing member 6.

The housing 5 is integrally formed with a-skirt 51. Therefore, when screwing the fixing member 6 in the chamber 52, it is necessary to deeply extend the fixing member 6 into the housing 5 and then screw the fixing member 6 in the inner thread 521. It is hard to directly screw the fixing member 6. A special wrench 7 having two chucking pillars 71, 72 is needed for wrenching the fixing member 6. The chucking pillars 71, 72 of the wrench 7 are inserted into the notches 62 of the fixing member 6 as shown in FIG. 7 for screwing the fixing member 6 in the chamber 52. When extending the fixing member 6 into the chamber 52, the fixing member 6 tends to deflect. Therefore, it is hard to assemble the fixing member 6 with housing 5.

Moreover, in order to reduce vibration of the motor set 53 in operation, two rubber sleeves 532 are respectively fitted around two ends of the casing 531 of the motor. The rubber sleeves 532 contact with the housing 5 and the fixing member 6 for achieving a damping effect. However, when locked in the chamber 52, the fixing member 6 tightly abuts against the rubber sleeves 532. Therefore, the damping effect will be reduced or even the rubber sleeves 532 will be broken.

Furthermore, the housing 5 is integrally formed with the skirt 51 so that the housing 5 has a considerable length. In the case that the housing 5 is made of plastic, the elongated housing 5 will increase the deformation of the injected plastic. Therefore, the housing 5 tends to deform. This will affect the assembly of the components in the housing 5.

FIG. 8 shows another pneumatic buffing machine in which the housing 9 and the skirt 8 are separately formed. The skirt 8 is fixed under the housing 9 by means of screws. The top face of the skirt 8 is formed with several through holes 82. The bottom end of the housing 9 is formed with several thread holes 91 corresponding to the through holes 82. Several screws 81 are passed through the through holes 82 and screwed into the thread holes 91 to lock the skirt 8 under the bottom of the housing 9. The motor set 92 is fixed at top end of the skirt 8.

The skirt 8 is fixed under the housing 9 by means of screws 81. Therefore, the section of the housing 9, where the thread holes 91 are formed must have a certain thickness. With respect to a small-size pneumatic buffing machine, the housing 9 has a relatively thin wall on which the thread holes 91 can be hardly formed. Under such circumstance, it is impossible to fix the skirt 8 under the housing 9 by screws 81. Moreover, in the case that the wall of the housing 9 is formed with the thread holes 91, the thickness of the wall will be reduced to minify the strength of the housing 9.

SUMMARY OF THE INVENTION

It is therefore a primary object of the present invention to provide a pneumatic buffing machine including a housing having an internal chamber in which a pneumatically driven motor set is mounted. The motor set includes an eccentric block for driving a grinding disc. A skirt shade is screwed under a bottom of the housing by means of outer thread and inner thread. The skirt shade has a large diameter section and a small diameter section. The skirt shade is formed with a central through hole. The eccentric block of the motor set is passed through the through hole and accommodated in the large diameter section. A shoulder section is formed between the large diameter section and the small diameter section and adjacent to the outer thread of the small diameter section. A top end of the small diameter section serves as a stopper section. When the skirt shade is screwed into the chamber of the housing, the bottom end of the housing abuts against the shoulder section to tightly fix the skirt shade and the stopper section abuts against the bottom of the motor set to fix the motor set in the chamber of the housing. The skirt shade can be manually directly screwed into the housing so that it is easy to assemble the skirt shade with the housing. In addition, the stopper section can reach a true position to abut against the motor set so that the motor set can be firmly fixed in the chamber of the housing.

The present invention can be best understood through the following description and accompanying drawings wherein:

DETAILED DESCRIPTION OF THE PREFERRED EMBODIMENTS

Figure 1:
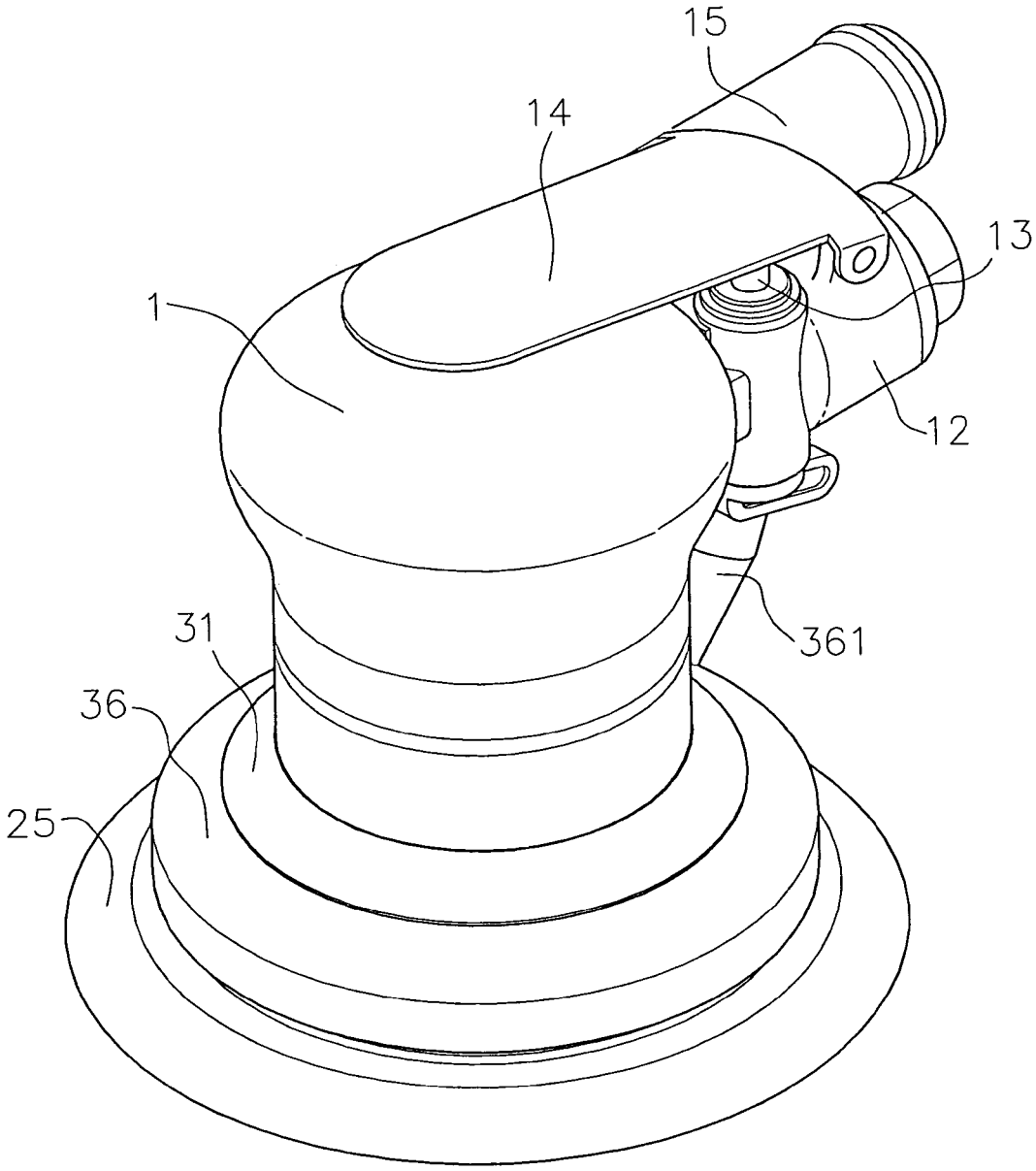
FIG. 1 is a perspective assembled view of the present invention.
Figure 2:
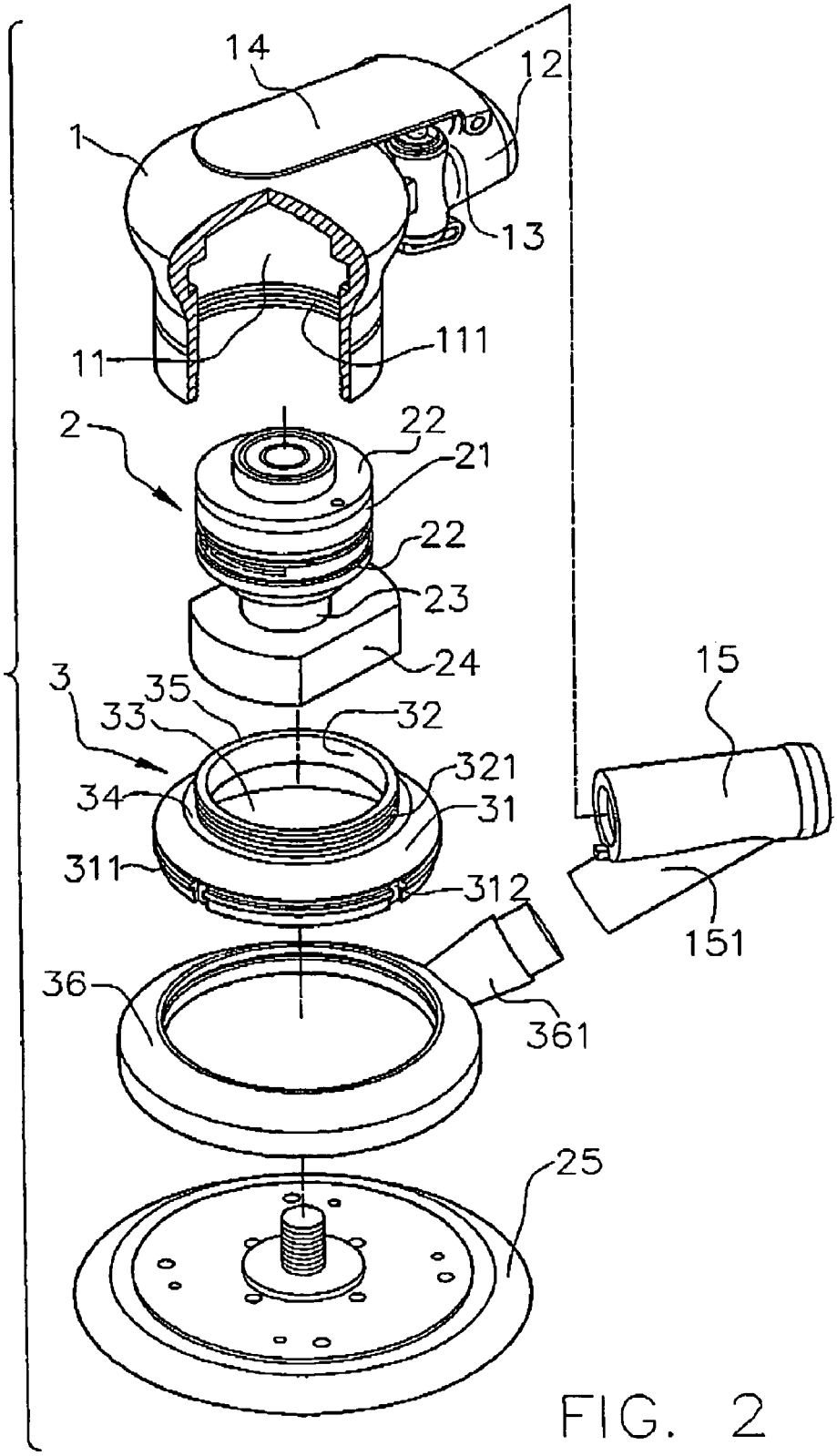
FIG. 2 is a perspective exploded view of the present invention.
Figure 3:
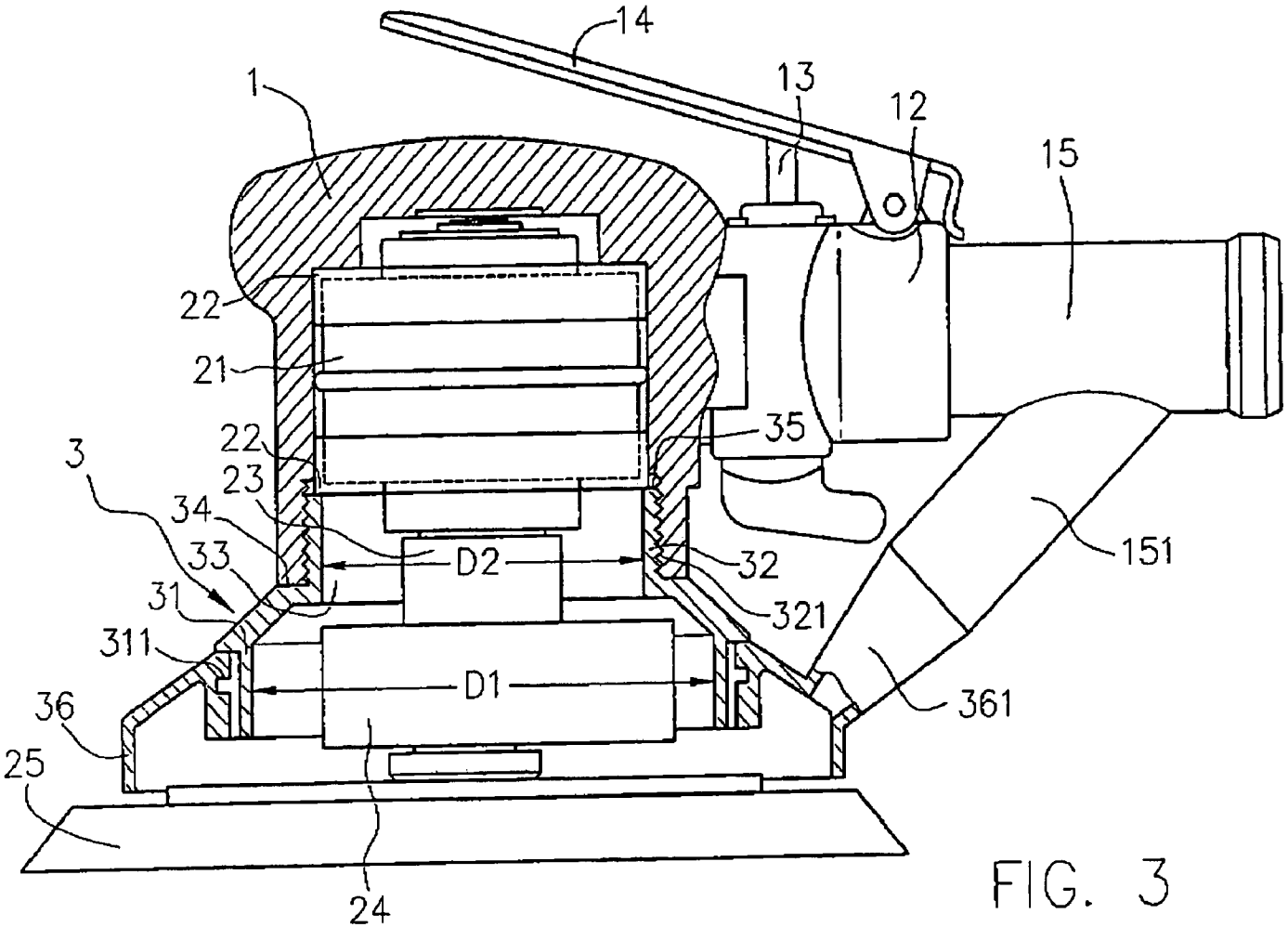
FIG. 3 is a sectional assembled view of the present invention.

Please refer to FIGS. 1 to 4. The pneumatic buffing machine of the present invention includes a housing 1 having an internal chamber 11 in which a pneumatically driven motor set 2 is mounted. The motor set 2 includes a motor 21. Two rubber sleeves 22 are respectively fitted around two ends of the motor 21. The motor 21 has a rotary shaft 23. An eccentric block 24 is fixed under bottom end of the rotary shaft 23. The eccentric block 24 extends out of the bottom of the housing 1 for fixedly connecting wit a grinding disc 25. A control handle 12 is disposed on one side of the housing 1 and connected with an air source and an exhaust pipe 15 for controlling intake and exhaust. An air valve 13 is disposed in the control handle 12 and controllable by a press shank 14 for controlling the air of the air source to enter the chamber 11 of the housing 1. The motor set 2 is driven by the air to further drive the grinding disc 25 for buffing a work piece.

A skirt shade 3 is screwed under the bottom of the housing 1. The skirt shade 3 has a large diameter section 31 and a small diameter section 32. The skirt shade 3 is formed with a central through hole 33. The eccentric block 24 of the motor set 2 is passed through the through hole 33 and accommodated in the large diameter section 31. The grinding disc 25 is fixedly connected under the skirt shade 3. The small diameter section 32 of the skirt shade 3 is formed with an outer thread 321. The bottom end of the chamber 11 of the housing 1 is formed with an inner thread 111 for screwing the small diameter section 32 of the skirt shade 3 in the chamber 11 of the housing 1. A shoulder section 34 is formed between the large diameter section 31 and the small diameter section 32 and adjacent to the outer thread 321 of the small diameter section 32. In addition, the top end of the small diameter section 32 serves as a stopper section 35. When the small diameter section 32 of the skirt shade 3 is screwed into the chamber 11 of the housing 1, the bottom end of the housing 1 abuts against the shoulder section 34 to tightly fix the skirt shade 3. In addition, the stopper section 35 abuts against the bottom of the rubber sleeve 22 of the motor set 2 to fix the motor set 2 in the chamber 11 of the housing 1.

The outer circumference of the large diameter section 31 of the skirt shade 3 is formed with an insertion section 311 on which a dustproof shade 36 is inserted to cover the grinding disc 25. The outer circumference of the insertion section 311 is formed with several notches 312 for a tool to engage with the large diameter section 31 and screw the skirt shade 3. In this embodiment, the dustproof shade 36 has a conduit 361 extending toward the exhaust pipe 15. The exhaust pipe 15 has a bypass 151 corresponding to the conduit 361. The conduit 361 is connected with the bypass 151 to communicate the dustproof shade 36 and the exhaust pipe 15. By means of the exhaust pressure of the exhaust pipe 15, a sucking force is applied to the air in the dustproof shade 36 for collecting the dust and powder in buffing operation.

Figure 4:
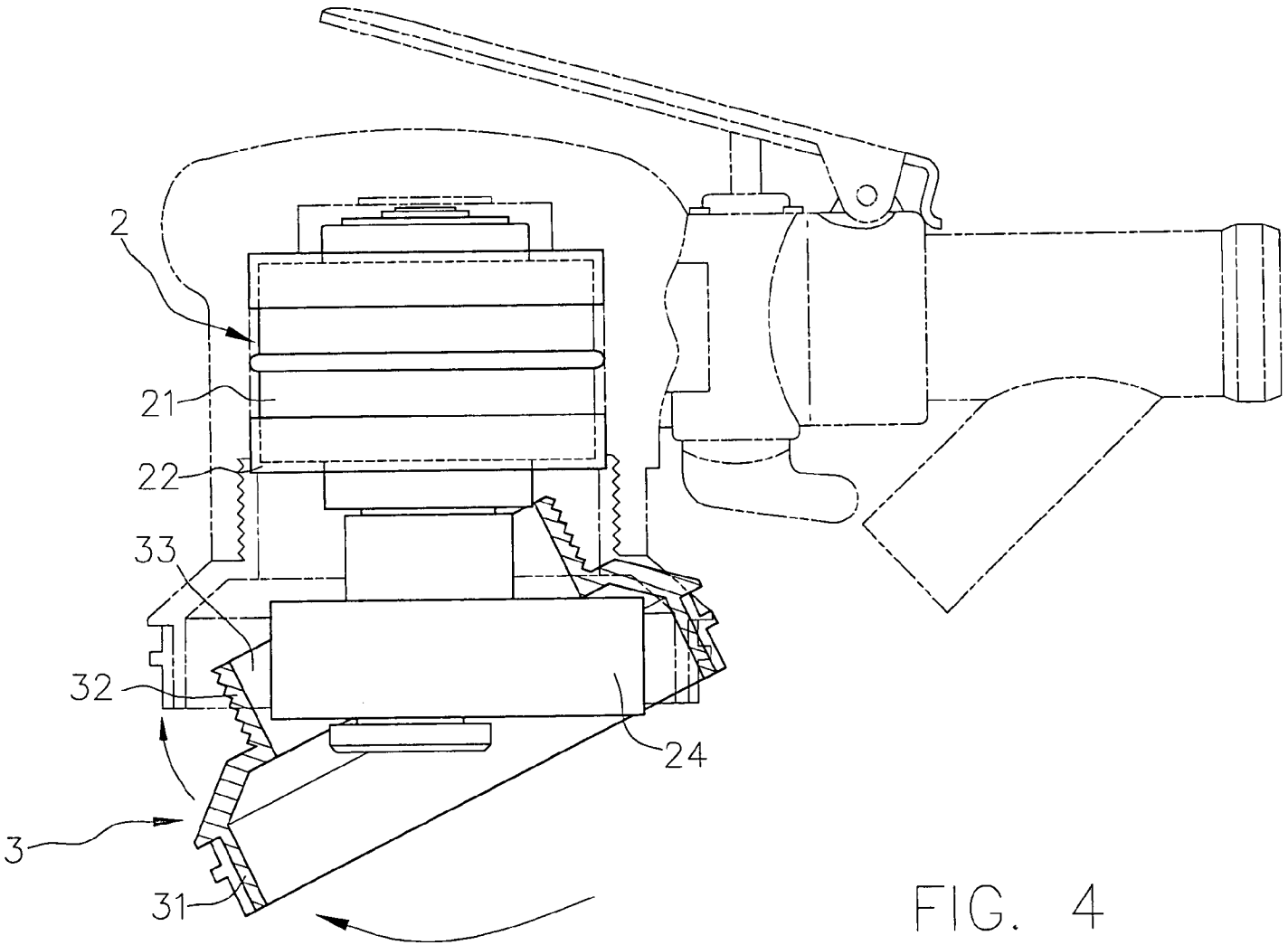
FIG. 4 is a partially sectional view showing the installation of the skirt shade of the present invention.
Figure 5:
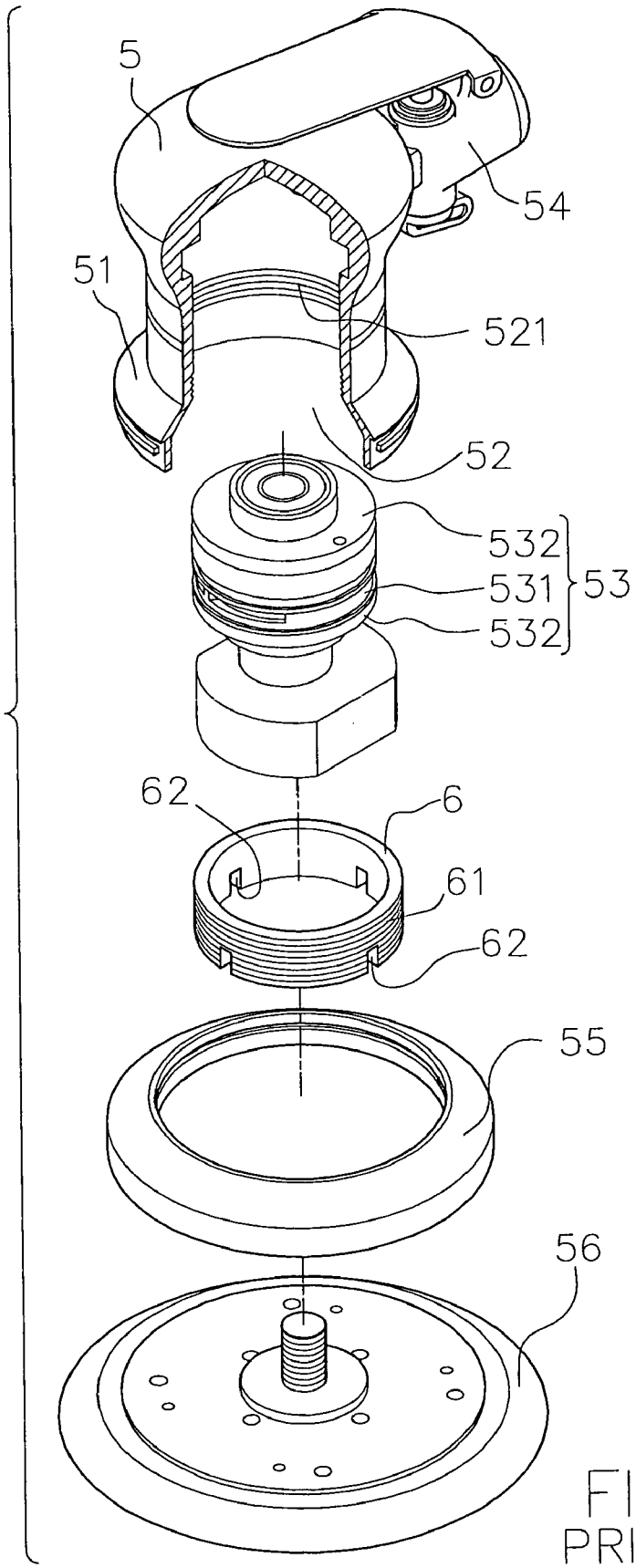
FIG. 5 PRIOR ART
FIG. 5 is a perspective exploded view of a conventional pneumatic buffing machine in which the housing and the skirt are integrally formed.
Figure 6:
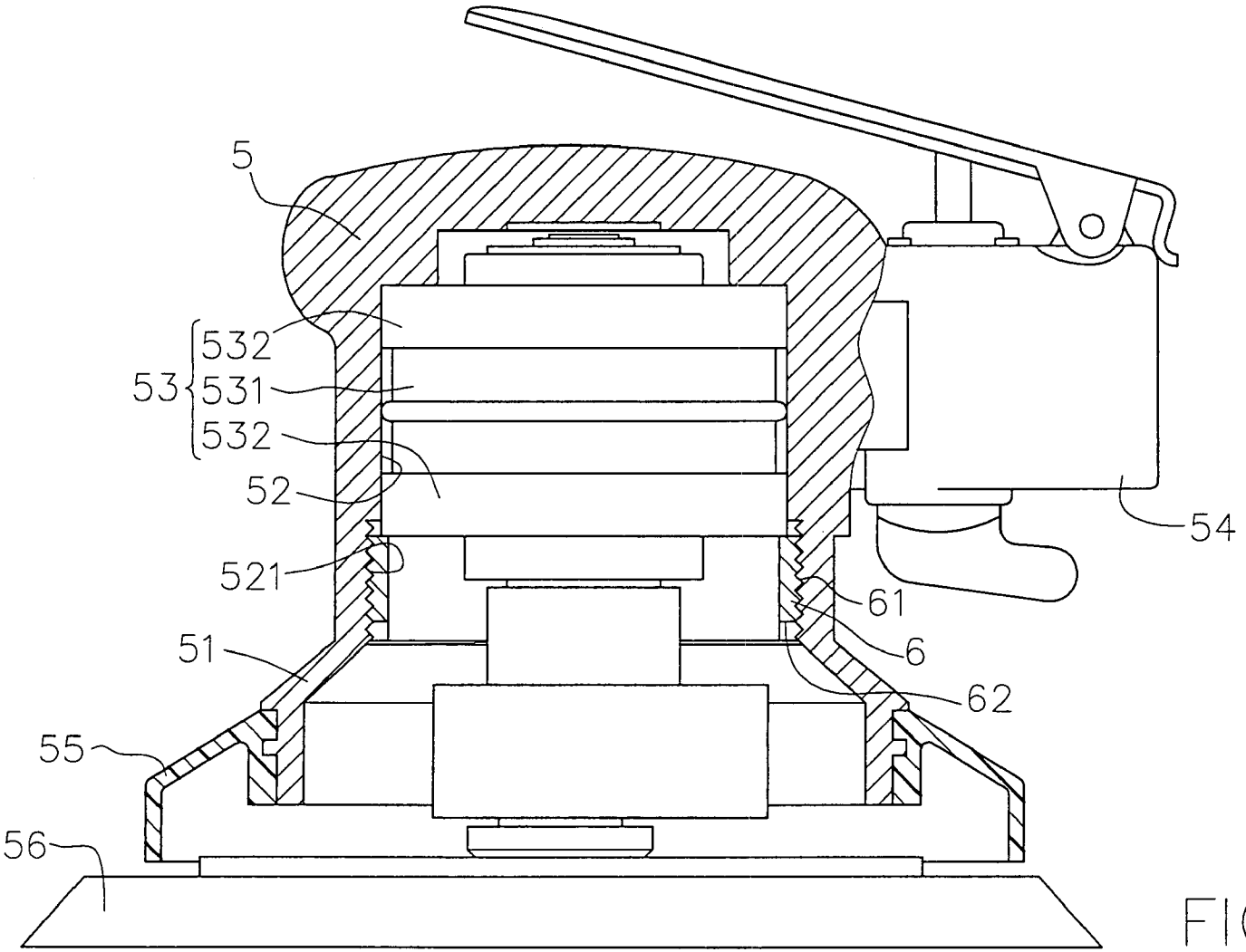
FIG. 6 PRIOR ART
FIG. 6 is a sectional assembled view according to FIG. 5.
Figure 7:
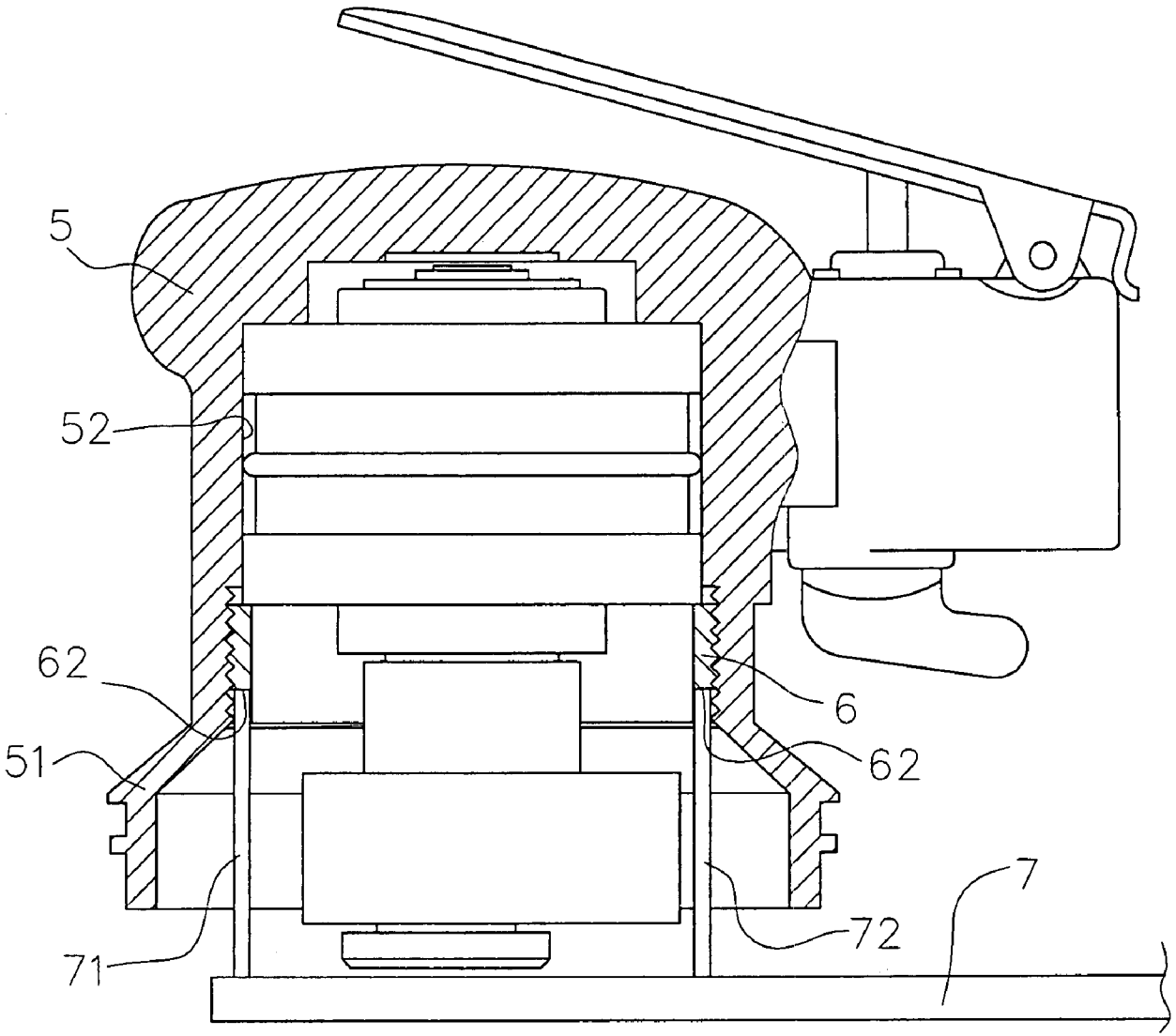
FIG. 7 PRIOR ART
FIG. 7 is a sectional view according to FIG. 6, showing that the fixing member is wrenched and tightened with a wrench.
Figure 8:
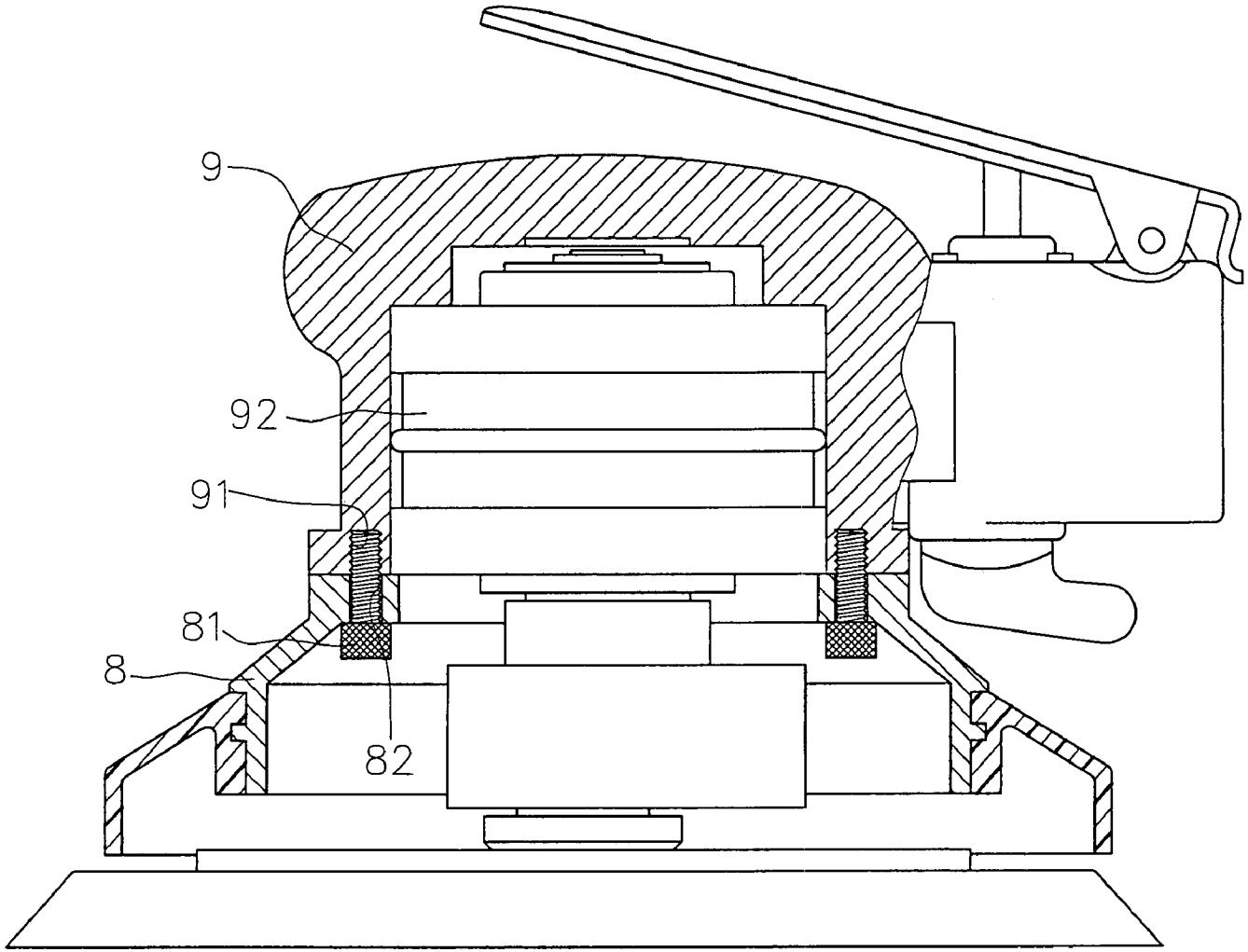
FIG. 8 PRIOR ART
FIG. 8 is a sectional view of another conventional pneumatic buffing machine.

The inner diameter of the small diameter section 32 of the skirt shade 3 is smaller than the outer diameters of the motor 21 and the rubber sleeve 22. The outer diameter of the eccentric block 24 is larger than the outer diameter of the motor 21. In addition, the eccentric block 24 is accommodated in the skirt shade 3. Therefore, the skirt shade 3 of the present invention is such designed as to be composed of the large diameter section 31 and the small diameter section 32. When assembled, the small diameter section 32 is obliquely fitted onto the eccentric block 24 as shown in FIG. 4. Then the skirt shade 3 is slightly turned to make the eccentric block 24 extend through the through hole 33 into the large diameter section 31. Then the skirt shade 3 is screwed into the housing 1.

The outer thread 321 of the small diameter section 32 of the skirt shade 3 is screwed into the inner thread 111 of the bottom end of the chamber 11 of the housing 1. Therefore, when assembled, a user only needs to hold the skirt shade 3 with a hand to easily aim the outer thread 321 at the inner thread 111 of the housing 1 and directly screw the skirt shade 3 into the housing 1. Finally, a tool is used to chuck the notches 312 of the insertion section 311 to wrench the skirt shade 3 and tighten the skirt shade 3 in the housing 1. The assembly is quite convenient.

Especially importantly, the shoulder section 34 is formed between the large diameter section 31 and the small diameter section 32 and adjacent to the outer thread 321 of the small diameter section 32. When tightening the skirt shade 3, the bottom end of the housing 1 abuts against the shoulder section 34 to tightly locate the housing 1. This can achieve double effects. First, the stopper section 35 can reach a true position to abut against the bottom of the rubber sleeve 22 of the motor set 2, whereby the motor set 2 can be firmly fixed in the chamber 11 of the housing 1. Therefore, the rubber sleeve 22 will not be over-pressed to reduce the damping effect or even broken to lose the damping effect as in the conventional technique. Second, by means of truly fixing the skirt shade 3, the dustproof shade 36 is indirectly located in a true position. Therefore, the conduit 361 of the dustproof dust 36 can be truly connected with the bypass 151 of the exhaust pipe 15.

Besides, the skirt shade 3 is directly screwed into the housing 1 without using any screws. Therefore, it is unnecessary to form any thread hole on the housing 1. Therefore, the present invention is applicable to small-size pneumatic buffing machine with thinner wall.

In addition, the skirt shade 3 and the housing 1 are separately formed so that the housing 1 will not be too long. In the case that the housing 1 is made of plastic, the deformation of the injected plastic is smaller. Therefore, the housing 1 is not subject to deformation so that the ratio of good products can be increased.

The above embodiments are only used to illustrate the present invention, not intended to limit the scope thereof. Many modifications of the above embodiments can be made without departing from the spirit of the present invention.

What is claimed is:

1. A pneumatic buffing machine comprising a housing having an internal chamber in which a pneumatically driven motor set is mounted, the motor set including, a motor coupled to an eccentric block for driving a grinding disc, a rubber sleeve passing around a circumference of an outer wall of said motor, a control handle being disposed on one side of the housing for controlling intake and exhaust, whereby air of an air source is controlled to enter the chamber of the housing for driving the motor set, said pneumatic buffing machine being characterized in that a unitary and one-piece skirt shade is screwed under a bottom of the housing, the skirt shade having a large diameter section and a small diameter section, said large diameter section having a diameter larger than a diameter of said small diameter section, the skirt shade being formed with a central through hole, the eccentric block of the motor set being passed through the through hole and accommodated in the large diameter section, the grinding disc being fixedly connected under the skirt shade, the small diameter section of the skirt shade being formed with an outer thread, a bottom end of the chamber of the housing being formed with an inner thread for screwing the small diameter section of the skirt shade in the chamber of the housing, a shoulder section being formed between the large diameter section and the small diameter section and adjacent to the outer thread of the small diameter section, a top end of the small diameter section serving as a stopper section, whereby when the small diameter section of the skirt shade is screwed into the chamber of the housing, the bottom end of the housing abuts against the shoulder section to tightly fix the skirt shade and the stopper section abuts against the rubber sleeve of the motor set to fix the motor set in the chamber of the housing.

2. A pneumatic buffing machine as claimed in claim 1, wherein an outer circumference of the large diameter section of the skirt shade is formed with an insertion section on which a dustproof shade is inserted to cover the grinding disc, an outer circumference of the insertion section being formed with several notches, whereby a tool engages with said notches to screw said skirt shade into said housing.

* * * * *